US008220550B2

(12) United States Patent
Dunn et al.

(10) Patent No.: US 8,220,550 B2
(45) Date of Patent: Jul. 17, 2012

(54) WELLHEAD HOUSING BOOTSTRAP DEVICE

(75) Inventors: Gregory M. Dunn, Houston, TX (US); Joseph W. Pallini, Jr., Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 461 days.

(21) Appl. No.: 12/489,679

(22) Filed: Jun. 23, 2009

(65) Prior Publication Data

US 2009/0314494 A1 Dec. 24, 2009

Related U.S. Application Data

(60) Provisional application No. 61/074,741, filed on Jun. 23, 2008.

(51) Int. Cl.
*E21B 23/00* (2006.01)

(52) U.S. Cl. ..... 166/351; 166/338; 166/360; 166/368

(58) Field of Classification Search ..... 166/351, 166/338–341, 352, 360, 368, 378–381, 85.1, 166/75.13
See application file for complete search history.

(56) References Cited

U.S. PATENT DOCUMENTS

| | | | | | |
|---|---|---|---|---|---|
| 2,230,712 | A * | 2/1941 | Bendeler et al. | ..... | 166/123 |
| 3,944,273 | A * | 3/1976 | Ahlstone | ..... | 294/86.1 |
| 4,030,544 | A * | 6/1977 | Ahlstone | ..... | 166/182 |
| 4,387,771 | A * | 6/1983 | Jones | ..... | 166/341 |
| 4,470,458 | A * | 9/1984 | Moore | ..... | 166/212 |
| 4,856,594 | A * | 8/1989 | Jennings | ..... | 166/338 |
| 4,901,794 | A * | 2/1990 | Baugh et al. | ..... | 166/118 |
| 4,934,459 | A * | 6/1990 | Baugh et al. | ..... | 166/380 |
| 5,069,287 | A * | 12/1991 | Short et al. | ..... | 166/339 |
| 5,069,288 | A * | 12/1991 | Singeetham | ..... | 166/348 |
| 5,088,556 | A * | 2/1992 | Short et al. | ..... | 166/339 |
| 5,107,931 | A * | 4/1992 | Valka et al. | ..... | 166/342 |
| 5,273,117 | A * | 12/1993 | Reimert | ..... | 166/348 |
| 5,307,879 | A * | 5/1994 | Kent | ..... | 166/382 |
| 5,316,089 | A * | 5/1994 | Fernandez | ..... | 175/7 |
| 5,421,407 | A * | 6/1995 | Thornburrow | ..... | 166/85.3 |
| 5,791,418 | A * | 8/1998 | Milberger et al. | ..... | 166/368 |
| 6,079,489 | A * | 6/2000 | Hult et al. | ..... | 166/68.5 |
| 6,386,291 | B1 * | 5/2002 | Short et al. | ..... | 166/368 |
| 6,682,107 | B2 * | 1/2004 | Munk et al. | ..... | 285/309 |
| 7,028,777 | B2 * | 4/2006 | Wade et al. | ..... | 166/343 |

(Continued)

OTHER PUBLICATIONS

Search Report, Application No. GB0910894.5, dated Sep. 30, 2009.

*Primary Examiner* — Thomas Beach
*Assistant Examiner* — Matthew Buck
(74) *Attorney, Agent, or Firm* — Bracewell & Giuliani LLP

(57) ABSTRACT

A running tool for coaxially setting together subsea wellhead housings, such as a high pressure wellhead housing within a low pressure wellhead housing. The tool includes a conically shaped body that is insertable within the inner most housing, a frame with a base, an axial bore and latches. The base perpendicularly rests on top of an inner housing and the latches extend from the base to connect with an outer housing. The bore is formed to accommodate the tool freely therethrough. Wedge shaped members are provided between the base and inner housing top having their wide ends contactable by the tool. Urging the tool through the bore pushes the wedges radially outward that imparts a force between the base and inner housing top in one direction. The attached latches apply an oppositely directed force onto the outer housing.

21 Claims, 6 Drawing Sheets

U.S. PATENT DOCUMENTS 7,240,735 B2 * 7/2007 Crozier ..... 166/344
7,614,453 B2 * 11/2009 Spiering et al. ..... 166/338
7,647,973 B2 * 1/2010 Minassian et al. ..... 166/338
2005/0126788 A1 * 6/2005 Crozier ..... 166/345
2005/0242519 A1 * 11/2005 Koleilat et al. ..... 277/434

* cited by examiner

WELLHEAD HOUSING BOOTSTRAP DEVICE

CROSS REFERENCE TO RELATED APPLICATIONS

This application claims priority to and the benefit of U.S. Provisional Application Ser. No. 61/074,741, filed Jun. 23, 2008, the full disclosure of which is hereby incorporated by reference herein.

FIELD OF THE INVENTION

This invention relates in general to production of oil and gas wells, and in particular to a device for coupling together high and low pressure wellhead housings.

DESCRIPTION OF RELATED ART

Systems for producing oil and gas from subsea wellbores typically include a subsea wellhead assembly that includes a wellhead housing attached at a wellbore opening, where the wellbore extends through one or more hydrocarbon producing formations. A typical subsea well assembly undergoes several installation procedures, including drilling, completion, and production installation procedures. Subsea well assemblies generally include an outer or low pressure wellhead housing from which a string of conductor pipe descends downward into the well. An inner or high pressure wellhead housing is coaxially landed and set within the outer wellhead housing. The inner wellhead housing can support one or more casing hangers and attached strings of casing inserted into the well. A latch and groove arrangement can be employed to support the inner housing in the outer housing. Setting the inner wellhead housing within the outer wellhead housing often requires axially forcing the inner wellhead housing in the outer wellhead housing until the latch and groove are in alignment.

SUMMARY OF THE INVENTION

Disclosed herein is a device for assembling a portion of a subsea wellhead housing that is used to set inner wellhead housing within outer wellhead housing; which is typically referred to as bootstrapping. The device disclosed herein amplifies the forces applied to a bootstrapping tool to produce a desired bootstrapping output force. The device employs a system of wedges to gain a mechanical advantage for force amplification. In one optional embodiment the bootstrap mechanism comprises a tapered activating tool that drives a set of wedges laterally between the shell of a bootstrap assembly and the top of inner wellhead housing. In this embodiment the system of wedges includes the tapered shape of the activating tool and the wedges that extend laterally over the top of the inner wellhead housing. An elongated stinger made of drill pipe is attached to the lower end of the tool to provide a downward force for driving the bootstrapping tool within the lateral wedges. Laterally urging these wedges results in a downward force applied to the top surface of the high pressure housing. The shell lower end couples with the outer wellhead housing and prevents the outer wellhead housing from moving downward with respect to the shell. The downward force applied to the inner wellhead housing urges it downward away from the shell into locking engagement with the outer wellhead housing.

DETAILED DESCRIPTION OF THE INVENTION

Figure 1:
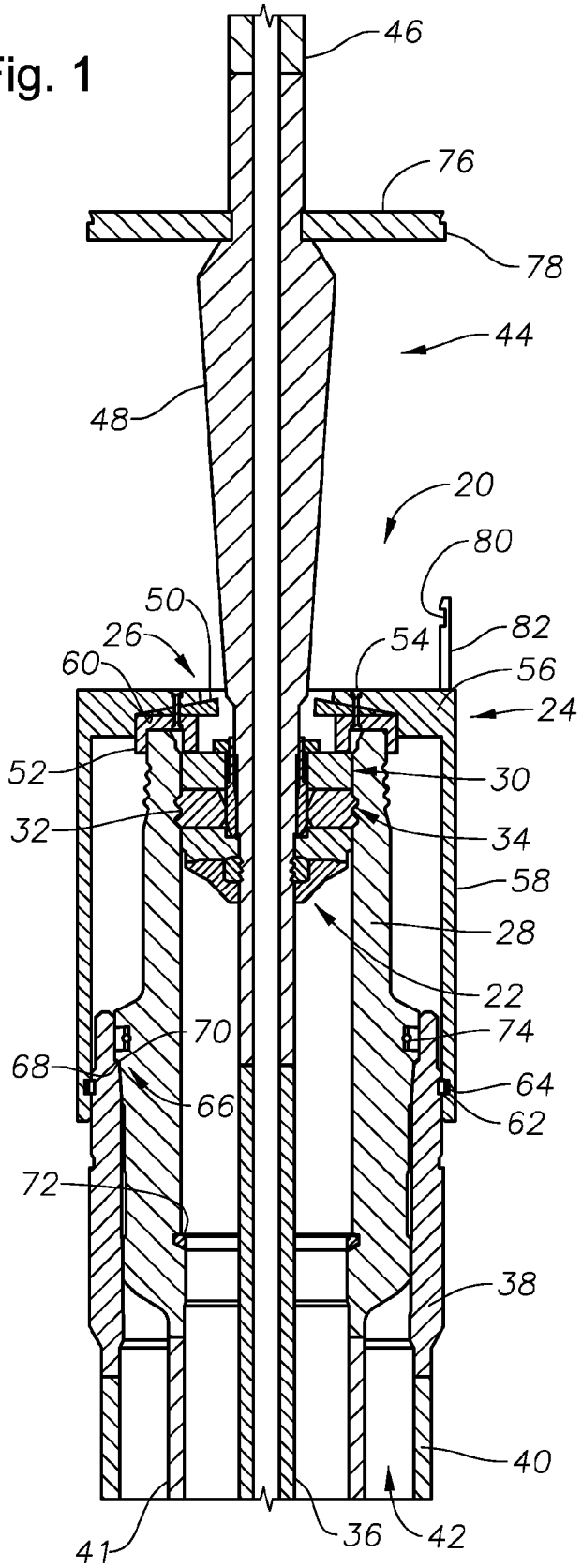
FIG. 1 is a sectional view of an embodiment of a wellhead assembly engaged with a bootstrap device.

The apparatus and method of the present disclosure will now be described more fully hereinafter with reference to the accompanying drawings in which embodiments are shown. This subject of the present disclosure may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the subject of the present disclosure is not limited to the exact details of construction, operation, exact materials, or embodiments shown and described, as modifications and equivalents will be apparent to one skilled in the art. In the drawings and specification, there have been disclosed illustrative embodiments of the subject disclosure and, although specific terms are employed, they are used in a generic and descriptive sense only and not for the purpose of limitation. Accordingly, the subject disclosure is therefore to be limited only by the scope of the appended claims.

Provided in a side cross sectional view in FIG. 1 is one embodiment of a bootstrapping tool/assembly 20 in accordance with the present disclosure. The assembly 20 can be used to couple inner and outer wellhead housings, such as for a subsea well. The bootstrap assembly 20 of FIG. 1 includes a housing running tool 22, a bootstrap shell or frame 24, and a wedge assembly 26. The housing running tool 22 is a generally elongated member shown latched within the inner circumference of a high pressure housing 28. The housing running tool 22 includes a dog latch assembly 30 for selectively attaching to the high pressure housing 28. The dog latch assembly 30 comprises dogs 32 disposed therein that can selectively project radially outward for coupling with corresponding profiles 34. The outer circumference of each dog 32 is shown contoured to mate with the profile 34 formed in the high pressure housing 28. An elongated tubular 36 is shown attached to the lower end of the housing running tool 22. The tubular 36, which can be drill pipe, provides a passive weight that, as will be described in more detail below, generates an activating force for bootstrapping the high pressure housing 28 within a low pressure housing 38. Conductor pipe 40 extending downward from the low pressure housing 38 circumscribes casing 41 shown attached to the high pressure housing 28 to form an annulus 42 therebetween.

An actuating tool 44 is formed on the upper portion of the housing running tool 22 above the dog latch assembly 30. The actuating tool 44 is attached on its upper end to drill pipe 46. The drill pipe 46 provides a raising and lowering means for the housing running tool 22. A profile 48 is formed on the outer periphery of the actuating tool 44. The profile 48 is a wedge shaped configuration, preferably conical, whose diameter increases upwards along the length of the actuating tool 44.

As shown in FIG. 1, the wedge assembly 26 is generally annular and disposed between upper terminal surface of the high pressure housing 28 and the shell 24. The wedge assembly 26 includes wedges 50 and a ring 52, where the wedges 50 are disposed on top of the ring 52 and oriented transverse to the ring 52 circumference. Ridges (not shown) may optionally be provided on the ring 52 upper surface for aligning and retaining the wedges 50. Bolts 54 are illustrated extending through elongated slots (not shown) in the wedges 50 and into the ring 52. The elongated slot and bolt 54 arrangement limits wedge 50 travel and further aids in wedge 50 orientation. The ring 52 has a contour that largely matches the upper terminal end of the high pressure housing 28 and may make up a single piece over all or a substantial portion of the high pressure housing 28 upper end. Optionally, the ring 52 may be multiple segments strategically located on the high pressure housing 28 upper surface. A number of wedges 50 may be included that are laterally oriented within the assembly 26. The wedge 50 cross section thickness increases as it approaches the assembly 26 inner diameter. In one embodiment, the wedges 50 are arranged equidistant apart around the wedge assembly 26.

In one embodiment the shell 24 is made up of an annular disk like base or upper section 56 and cylindrical walls 58 extending downward from the upper section 56 outer diameter. Optionally, elongated members, such as arms or beams may form a structural connection between the low pressure housing 38 and high pressure housing 28 to bootstrap the two together. The upper section 56 lies in a plane largely perpendicular to the housing running tool 22 axis, and includes a passage along its axis through which the housing running tool 22 is inserted. The shell 24 upper section 56 includes a lower surface 60 shown resting on the wedge assembly 26 upper surface. The lower surface 60 is angled to correspond to the increasing wedge 50 thickness and may also include ridges or slots for aligning the wedges 50. More specifically, in the embodiment of FIG. 1, the lower surface 60 tapers downward toward the high pressure housing 28 with increasing radius, thereby increasing the upper section 56 thickness. As shown, a latch assembly 62 is provided on walls' 58 lower terminal end; the latch assembly 62 is formed to engage a raised shoulder 64 on the low pressure housing 38 outer circumference. Latch assembly 62 may be a split ring that snaps inward as it engages recess 64. Other latching means exist for selectively coupling the shell 24 to the low pressure housing 38; examples include a C-ring, collet fingers, and an interference press fit, to name but a few.

In one embodiment of use of the bootstrap assembly 20 disclosed herein, the assembly 20 is latched to the high pressure housing 28 on a floating platform above the sea. In this example, the low pressure housing 38 has been landed on the seafloor over a wellbore bored through the seafloor. The assembly 20 with its downwardly depending drill pipe 36 and attached high pressure housing 28 is lowered subsea toward the wellbore for mating with the low pressure housing 38. In one embodiment, the upper drill pipe 46 provides the lowering means. Accordingly, in this configuration the dogs 32 of the dog latch assembly 30 are engaged with the profile 34 on the high pressure housing 28. The wedge assembly 26 is retained between the upper end of the high pressure housing 28 and the lower surface 60. The shell 24 shown seated on the wedge assembly 26, may be temporarily secured in place when lowering the assembly onto the housing.

Figure 1A:
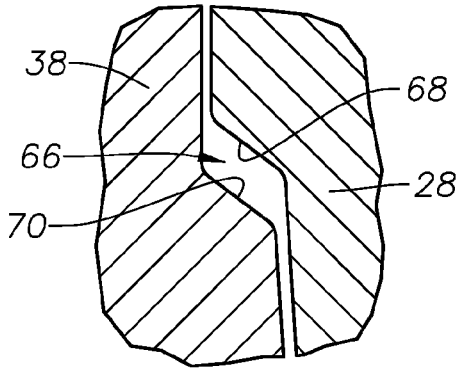
FIG. 1A depicts in a sectional view an enlarged portion of the wellhead assembly of FIG. 1.

Continued lowering of the assembly ultimately stabs the high pressure housing 28 coaxially within the low pressure housing 38. Adding corresponding conical shapes to the high pressure housing 28 lower end and low pressure housing 38 upper end eases high pressure housing 28 insertion within the low pressure housing 38. FIG. 1A illustrates in a sectional view, an enlarged portion of the interface between the high and low pressure housings 28, 38. As shown in FIG. 1, when initially landed onto the low pressure housing 38, a gap 66 remains between a shoulder 68 formed on the outer circumference of the high pressure housing 28 and a shoulder 70 on the inner circumference of the low pressure housing 38. The latch assembly 62 latches with the raised shoulder 64 thereby preventing downward movement of the low pressure housing 38 with respect to the shell 24. The raised shoulder 64 may alternatively be a permanently formed protrusion on the outer circumference of the low pressure housing 38, or may be made up of multiple protrusions, similar to a collet assembly. Once latched an upward force applied to the shell 24 transfers to low pressure housing 38.

After the initial landing, and for fully engaging the high pressure housing 28 with the low pressure housing 38, the dogs 32 of the dog latch assembly 30 are released from the profile 34. Hydraulics or a mechanical linkage (not shown) can be provided within the tool assembly 20 for actuating the latch assembly 30. Optionally, the dog latch assembly 30 can be provided so that rotating or stroking the drill pipe 46 retracts or extends the dogs 32. The mass of the drill pipe 36, combined with the mass of the housing running tool 22 and drill pipe 46, causes the running tool 22 to drop downward to a lower position within the high pressure housing 28. An example of the downward movement with the running tool 22 in the lowered position is provided in a side cross sectional view in FIG. 2. A load shoulder 72 shown formed on the high pressure housing 28 inner circumference, is engagable by the running tool 22 in the lower portion to limit downward travel of the running tool 22 within the high pressure housing 28.

Figure 2:
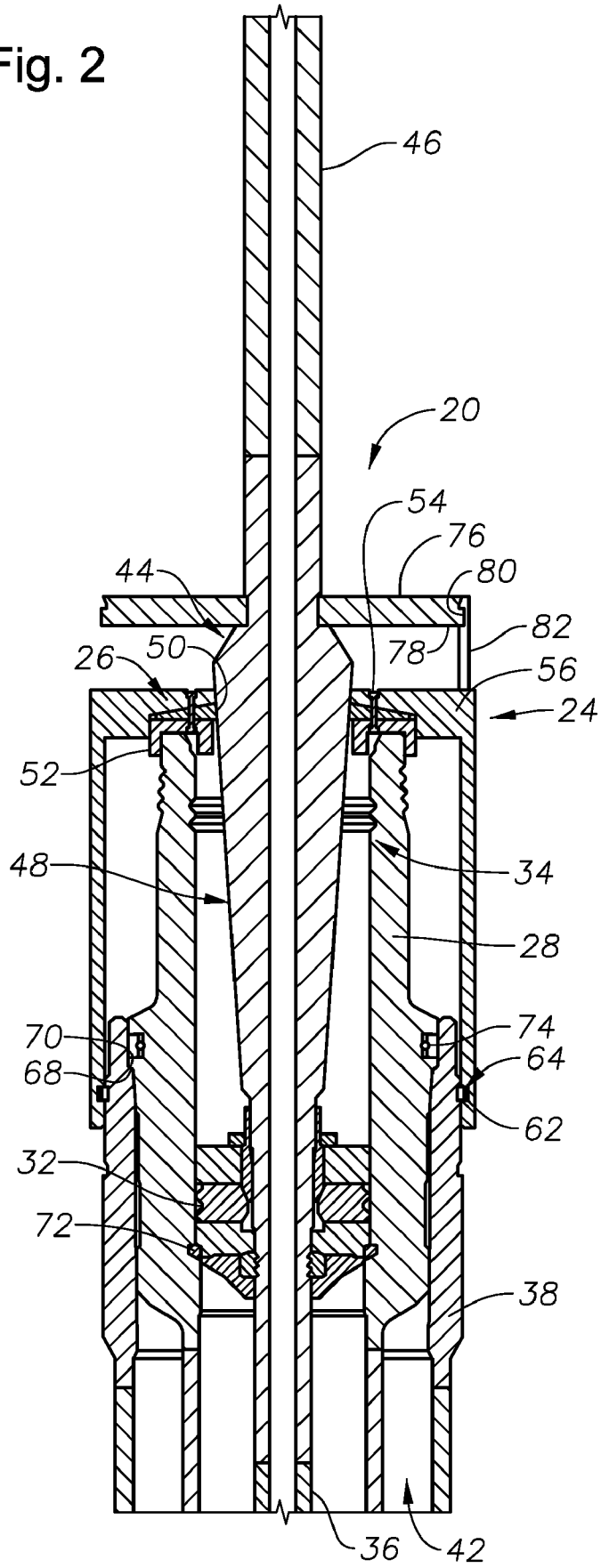
FIG. 2 is a cross sectional view of an embodiment of a wellhead assembly being formed by a bootstrap device.

FIG. 2 also depicts the outer profile 48 radially outwardly urging the wedges 50 by its downward movement through a bore in the base 56. This moves each wedge 50 so a thicker section is between the lower surface 60 and high pressure housing 28. As explained above, the latch assembly 62 is engaged with the recess 64 on outer wellhead housing 38, thus an upward force on the base tensions the frame 24 walls that in turn exerts oppositely directed forces on each of the high pressure housing 28 and low pressure housing 38. As the wedges 50 move radially outward, they exert an upward force on shell 24 and a downward force on wellhead housing 28. The forces urge together the opposing shoulders 68, 70, thereby reducing or eliminating the gap 66. Another latch 74 is included for coupling the low pressure housing 38 and high pressure housing 28 once shoulders 68, 70 engage one another. In the embodiment shown, the latch 74 includes a C-ring disposed on the outer circumference of a portion of the high pressure housing 28. The downward force applied to the high pressure housing 28 moves the high pressure housing 28 and the C ring into alignment with a corresponding channel of the low pressure housing 38. The alignment allows the C ring to expand into a locking engagement between these two housings 28, 38 for an additional securing means between the two housings 28, 38.

Figure 3:
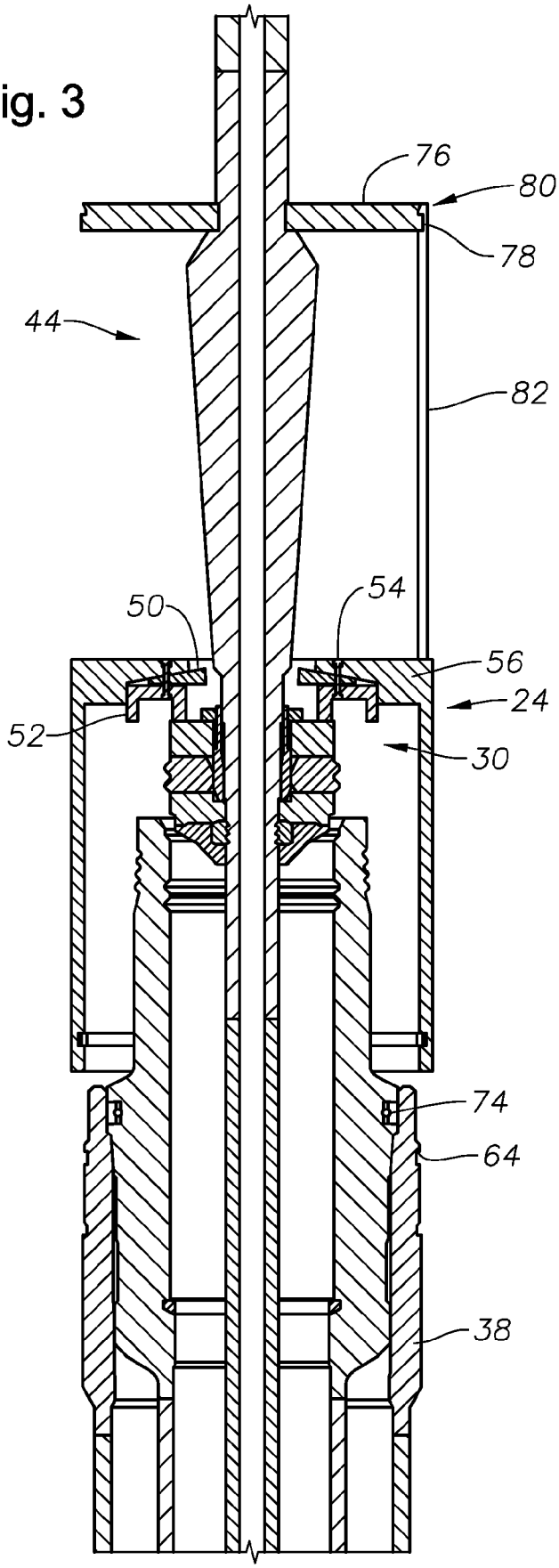
FIG. 3 illustrates the bootstrap device of FIG. 2 being withdrawn from the wellhead assembly.

Shown in FIGS. 1 and 2 is a bar puller 76 transversely mounted on the actuating tool 44 above the outer profile 48. The bar puller end 78 includes a rabbet like contour formed to couple with a groove 80 on an upper end of a latch release bar 82. As seen in FIG. 2, when the actuating tool 44 is at its full downstroke, the puller end 78 has engaged the groove 80 thereby coupling the bar puller 76 and latch release bar 82. FIG. 3 provides a side partial sectional view of the actuating tool 44 on its subsequent upstroke. The coupling between the end 78 and the groove 80 pulls the latch release bar 82 upward from within the shell 24. The latch release bar 82 is connected to a latch release assembly (not shown) within the shell 24. Drawing the latch release bar 82 upward actuates the latch release assembly separating the latch assembly 62 from the recess 64 so the shell 24 can be decoupled from the low pressure housing 38. The release assembly may include a lower portion of bar 82 that extends through a hole in the sidewall of the frame 24 and pushes latch ring 64 radially outward from its engagement with recess 62. Continued upward movement of the tool 44 contacts the upper surface of the dog latch assembly 30 with the lower end of the ring 52 to retrieve the shell 24 from the wellhead assembly.

Optionally, removing the boot strap assembly 20 may begin by releasing the engagement between the groove 64 and the latch assembly 62 with a remotely operated vehicle (ROV). For example, in the embodiment where the latch 62 is a C ring, the split portion may be engaged and pushed outward thereby urging the ring totally out of the channel 64 on the low pressure housing 38 and into the shell 24. This disengagement allows shell 24 to move upward. The shell 24 can alternatively be pulled upward by contact of an extended profile (not shown) extending from the outer surface of the housing running tool 22 and into contact with the upper end 56 of the shell 24.

Advantages of the present device include the use of two separate wedge portions, one being the profiles 48 on the activating tool 44 and the other being the wedges 50 of the wedge assembly 26. Mechanical advantage is provided by the tool 44 length combined with the relatively short outward radial movement of the wedges 50 to provide a downward force and movement of the high pressure housing 28. In one example, approximately 50,000 lbs of drill pipe weight provided as the tubular 36 could deliver a boot strapping force of about 1,000,000 lbs for coupling the high pressure housing 28 onto the low pressure housing 38.

Figure 4:
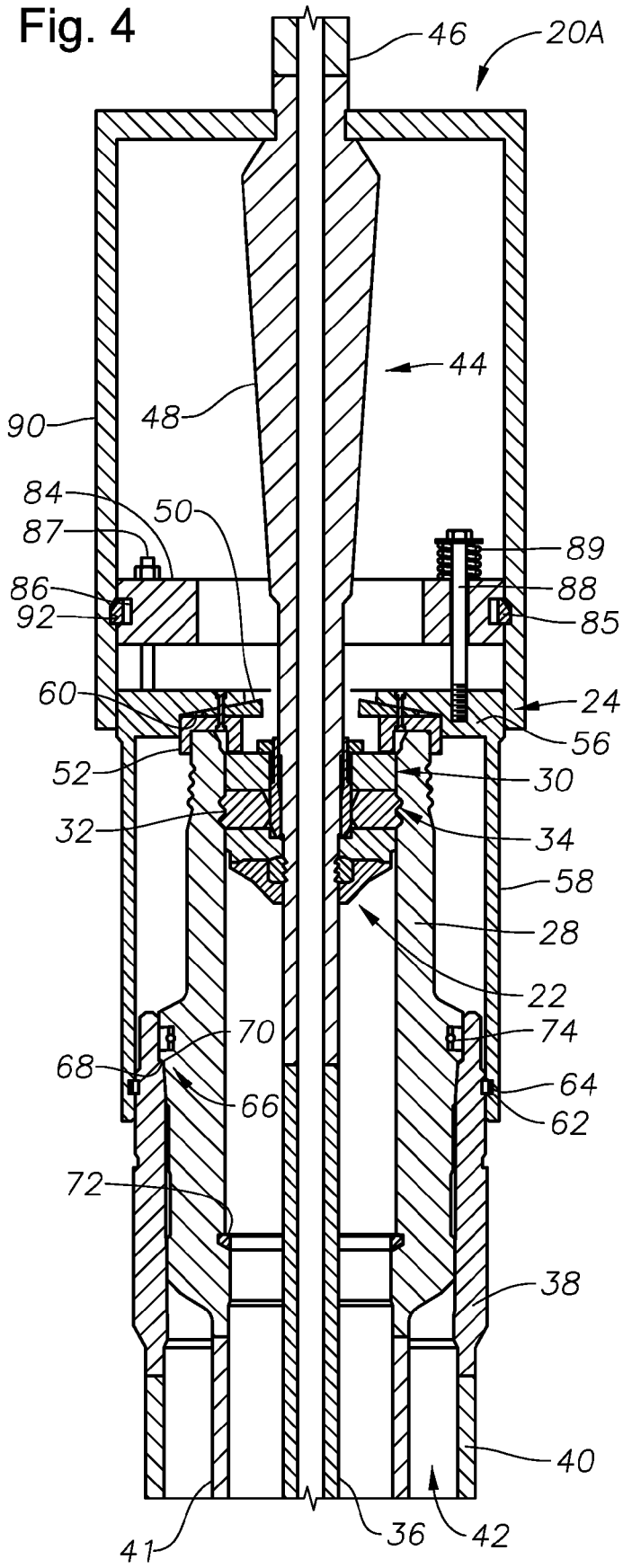
FIGS. 4 and 4A show in side partial sectional views, operational steps of an alternative bootstrap mechanism.

An alternative system for releasing the bootstrap mechanism is shown in a side partial sectional view in FIG. 4 In the embodiment, the bootstrap assembly 20A includes a latch release ring 84 is shown coaxially disposed atop the frame 24. A split C-ring 85 is shown in a groove 86 formed along the latch release ring 84 outer circumference. The C-ring 85 outer radial surface is profiled shown depending radially inward along a path from its middle to its upper end. A release bar 87, similar to the release bar 82, is shown projecting axially through the latch release ring 84 having its upper end bolted atop the latch release ring 84. Below the latch release ring 84, the release bar 87 extends through the shell 24 into coupling engagement with the latch assembly 62. In the configuration shown the latch release ring 84 is spaced apart from the shell upper section 56 that tensions the release bar 87 to retain the latch assembly 62 in an open configuration. A retention bar 88 is shown that also projects axially through the latch release ring 84. A spring 89 provided around the bar 88 is preloaded against the bar 88 upper end to apply a downward force against the latch release ring 84. In one embodiment, up to eight release bars 87 and/or eight retention bars 88 are included with the assembly 20A; in another embodiment, the release bars 87 are spaced equidistance apart and the retention bars 88 are spaced equidistance apart. An outer shell 90 is shown circumscribing the actuating tool 44 that is dimensioned for selective coaxial placement around the shell 24. The outer shell 90 is depicted as a tubular member depending downward from attachment with the actuating tool 44. In its natural uncompressed configuration, the split C-ring 85 outer circumference exceeds the latch release ring 84 outer circumference. However, as shown in FIG. 4, the outer shell 90 contacts and compresses the split C-ring 85 so that at least a portion of it remains within the groove 86.

Figure 4A:
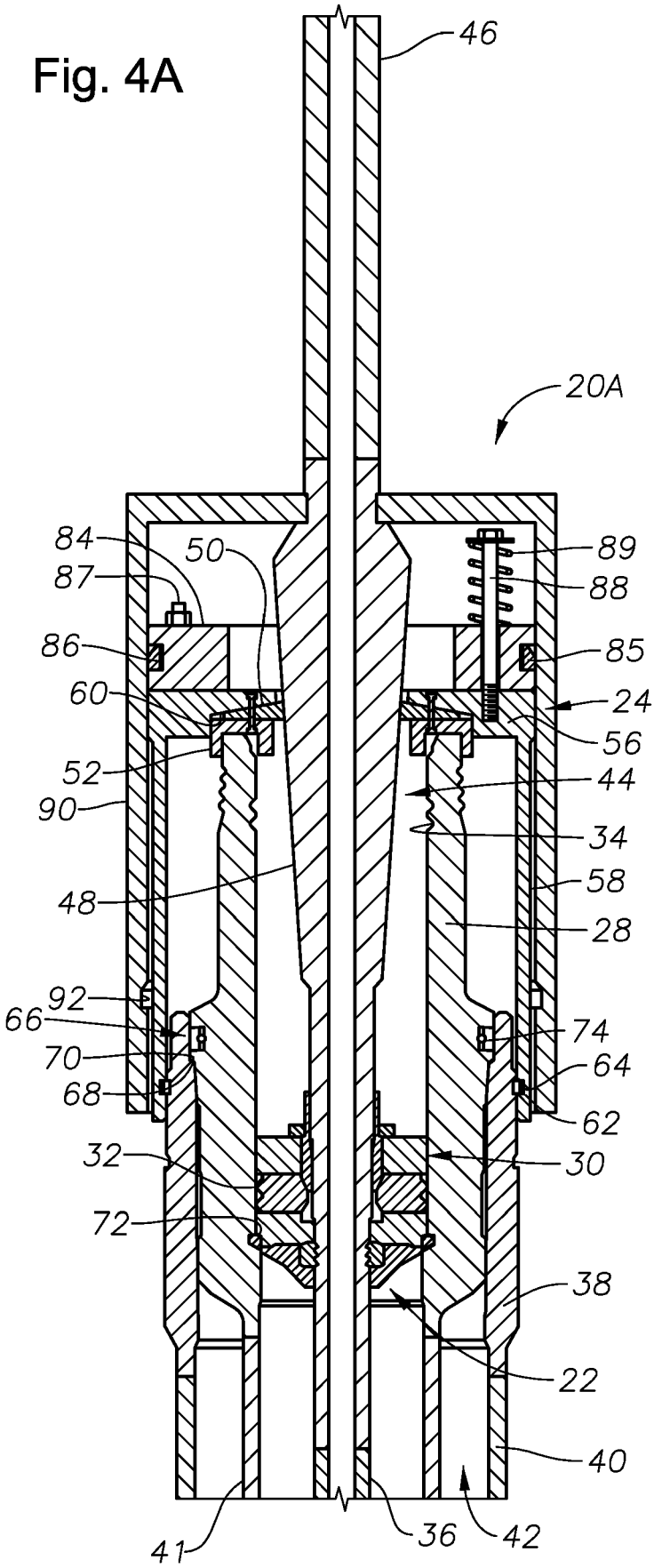

A groove 92 shown in the shell 90. On its lower end the groove 92 forms a ledge in the shell 90 inner surface substantially perpendicular to the shell 90 wall. On its upper end, the groove 92 transitions along a line that is oblique to the shell 90 inner surface. The groove 92 shape and split C-ring 85 are correspondingly profiled on their respective upper portions thereby preventing coupling between the split C-ring 85 and the groove 92 as the outer shell 90 slides downward. As shown in FIG. 4A, the actuating tool 44 is being urged through the central opening of the array of wedges 50 in the wedge assembly 26 to slide the groove 92 past the split C-ring 85 and land the latch release ring 84 on top of the shell upper surface 56. This pushes the release bar 87 downward allowing coupling between the latch assembly 62 and raised shoulder 64 so that the upward force from the outwardly extending array of wedges 50 upwardly pulls the shell 24 and low pressure housing 38 with respect to the high pressure housing 28. While the assembly 20A is at or near the bottom of its downward travel, the latch assembly 62 remains activated by the spring 89 through its downward force onto the release ring 84 that is transferred to the release bar 87.

Figure 5:
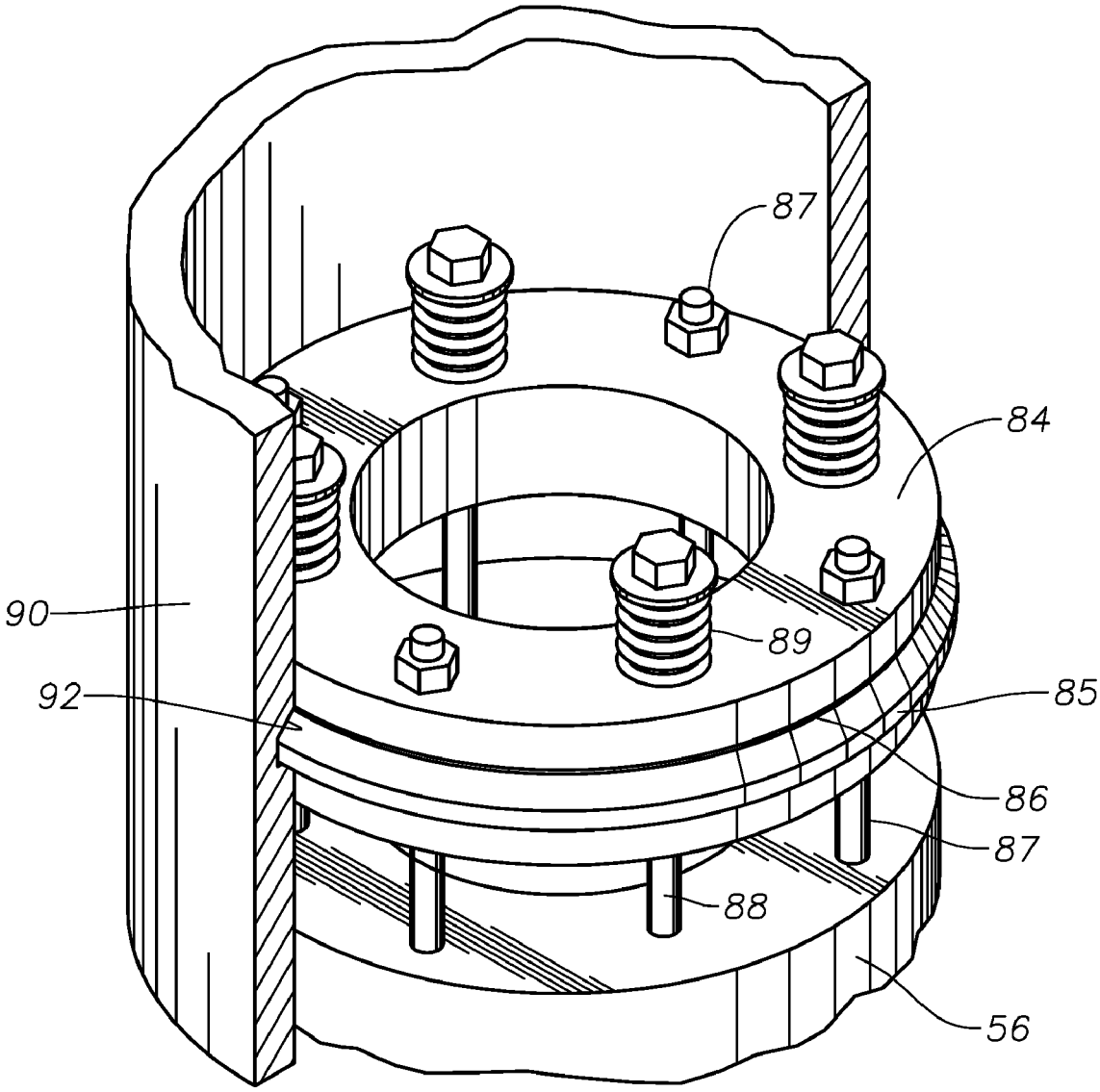
FIG. 5 illustrates a perspective view the bootstrap mechanism of FIG. 4.

Referring now to FIG. 5, as the tool 44 is drawn upwards along with the attached outer shell 90, the split C-ring 85 radially expands outward as it becomes aligned with the groove 92. The perpendicularly oriented groove 92 lower surface engages the lower side of the split C-ring 85 thereby coupling the shell 90 with the latch release ring 84. As the shell 90 is further drawn upward, this upwardly pulls the latch release ring 84 and release bar to decouple the latch assembly 62 and raised shoulder 64 so the shell 24 can be raised upward. In some instances it may not be possible to push the actuating tool 44 to full downstroke position. Thus strategically positioning the groove 92 enables engaging the latch release ring 84 even if the actuating tool 44 does not reach full downstroke.

The present system and method described herein, therefore, is well adapted to carry out and attain the ends and advantages mentioned, as well as others inherent therein. While a presently preferred embodiment has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of setting an inner wellhead housing into a subsea outer wellhead housing, comprising:

a) deploying the inner wellhead housing within the outer wellhead housing;

b) setting a radially moveable wedge array on top of the inner wellhead housing;

c) positioning a shell on the wedge array and coupling the shell to the outer wellhead housing; and d) passing an axially moveable wedge member axially within a central opening of the wedge array, causing the wedge array to move outward, exerting an upward force on the shell and a downward force on the inner wellhead housing, the upward force being reacted through the shell to the outer wellhead housing.

2. The method of claim 1, wherein the axially moveable wedge member comprises an elongated wedge having a thickness that increases in an upward direction and step (d) comprises moving the elongated wedge downward.

3. The method of claim 1, wherein the wedge array, wedge member, and shell are coupled to the inner wellhead housing at a surface of the sea and lowered as a unit into engagement with the outer wellhead housing.

4. The method of claim 1, wherein step (d) comprises applying a weight from a string of pipe to the axially moveable wedge member.

5. The method of claim 1, wherein step (c) comprises releasably latching the shell to the outer wellhead housing before step (d).

6. The method of claim 1, further comprising latching the inner wellhead housing to the outer wellhead housing wherein the axially moveable wedge member reaches a set position.

7. The method of claim 1, further comprising attaching a lower section of pipe to and between the axially movable wedge member and an upper section of pipe to and above the axially movable wedge member and using the weight of the upper and lower string of pipe to cause the axial movement of the axially movable wedge member.

8. The method of claim 1, further comprising after step (d) releasing the shell from the outer wellhead housing and removing the shell, radially movable wedge array and axially movable wedge member from the inner and outer wellhead housings.

9. The method of claim 8, further comprising providing a latch release mechanism and a puller on the axially movable wedge member that engages the release mechanism and releases the shell when a wellhead housing is in a set position within the outer wellhead housing.

10. The method of claim 9, wherein the puller is a member selected from the list consisting of a tubular member having a groove on its inner surface configured to mate with the latch release and a cantilever configured to mate with the latch release.

11. A method of setting an inner wellhead housing within a subsea outer wellhead housing comprising:

a) coaxially inserting the inner wellhead housing into the outer wellhead housing;

b) providing wedge members on the inner wellhead housing that each projects radially outward from a middle portion of the inner wellhead housing and each has a height that decreases with distance from the middle portion, so that when set on the inner wellhead housing a central opening is defined between ends of the wedge members facing the middle portion;

c) placing a coupling device on top of the wedge members and attaching the coupling device to the outer wellhead housing; and d) passing an elongated wedge through the central opening, so that when a wider portion of the elongated wedge contacts the ends of the wedge members facing the middle portion, a weight of the elongated wedge is converted to a force that urges the wedge members radially outward to produce a downwardly directed force on the inner wellhead housing for setting together the inner and outer wellhead housings.

12. The method of claim 11, further comprising attaching the inner wellhead housing to the elongated wedge and lowering the elongated wedge with attached inner wellhead housing so that steps (a) and (d) occur at about the same time.

13. The method of claim 11, further comprising attaching a pipe string to the elongated wedge.

14. The method of claim 11, further comprising adjusting the angle between the elongated wedge axis and its outer surface, the elongated wedge length, and the angle between the outer surface and axis of the wedge members to manipulate the magnitude of the force.

15. A system for coupling inner and outer subsea wellhead housings, the system comprising:

a radially movable wedge array that mounts on the inner wellhead housing and has a central opening, an axially movable wedge member extending through the opening and having a run-in position and a set position;

a shell mounted on the radially movable wedge array, the shell having a depending portion for placement alongside the outer wellhead housing;

a latch member on the depending portion of the shell and engagable with the outer wellhead housing, such that axial movement of the axially movable wedge member after the latch member has engaged the outer wellhead housing causing the axially movable wedge array to move radially outward to apply a downward force on the inner wellhead housing and an upward force on the outer wellhead housing.

16. The system of claim 15, wherein the axially movable wedge member has an increasing thickness in an upward direction so that downward movement of the axially movable wedge member provides the force onto the radially movable wedge array to push it radially outward.

17. The system of claim 15, further comprising a pipe string on the axially movable wedge member upper and lower ends, wherein the weight of the pipe strings and axially movable wedge forces the axially movable wedge downward.

18. The system of claim 15, further comprising a latch assembly on the axially movable wedge member that engages a profile on the inner wellhead housing, enabling the axially movable wedge member, the shell, and the inner wellhead housing to be lowered as a unit into the outer wellhead housing.

19. The system of claim 15, wherein a latch between the inner and outer wellhead housings latches when the axially movable wedge member is in the set position.

20. The system of claim 15, further comprising a puller on the axially movable wedge member, an unlatching device coupled with the latch member, the puller engaging the unlatching device to release the latch member when the axially movable wedge is in the set position.

21. The system of claim 15, wherein the latch member comprises:

a member selected from the list consisting of a cantilever with an end adapted to engage the unlatching device; and a sleeve having an inner surface that circumscribes the shell when in the set position and a groove in the inner surface adapted to receive the unlatching device therein when pulled upward.

* * * * *